United States Patent [19]

Stuckmann et al.

[11] 4,398,845

[45] Aug. 16, 1983

[54] TUNNEL DRIVING APPARATUS

[75] Inventors: Dieter Stuckmann, Selm; Hans Jütte, Dortmund-Holthausen, both of Fed. Rep. of Germany

[73] Assignee: Gewerkschaft Eisenhutte Westfalia, Lunen, Fed. Rep. of Germany

[21] Appl. No.: 271,337

[22] Filed: Jun. 8, 1981

[30] Foreign Application Priority Data

Dec. 6, 1978 [DE] Fed. Rep. of Germany ..... 2852663

[51] Int. Cl.[3] ..... E01G 3/02

[52] U.S. Cl. ..... 405/145; 405/141; 405/138

[58] Field of Search ..... 405/141–147

[56] References Cited

U.S. PATENT DOCUMENTS

| | | | |
|---|---|---|---|
| 794,633 | 7/1905 | Moir | 405/147 |
| 834,732 | 10/1906 | Japp | 405/145 |
| 1,275,910 | 8/1918 | Hamilton | 405/145 X |
| 4,112,696 | 9/1978 | Jutte et al. | 405/145 |
| 4,120,165 | 10/1978 | Stuckmann et al. | 405/145 |

FOREIGN PATENT DOCUMENTS

| | | | |
|---|---|---|---|
| 773281 | 10/1980 | U.S.S.R. | 405/145 |

*Primary Examiner*—Dennis L. Taylor

*Attorney, Agent, or Firm*—Sughrue, Mion, Zinn, Macpeak and Seas

[57] ABSTRACT

Tunnel driving apparatus incorporates a cutter shield with a plurality of drive members or cutters arranged side-by-side in a cylindrical array. The drive members are supported and guided for individual longitudinal displacement on a cylindrical continuous cowl or casing forming at least part of a support frame. Rams which serve to shift the drive members and the frame are coupled therebetween and extend through sealed openings in an end wall of a recess formed on the exterior of the cowl and open towards the drive members.

To facilitate the creation of a concrete lining for the tunnel behind the cutter shield, a rear shield is formed by reduced rearwardly extending tails of the drive members. A further cylindrical casing locates within the rear shield and supports a pair of annular rings. One of these rings combines with a sheathing extending inside the further casing and the rear shield to form a concrete reception space. The other ring is fixed to the further casing and locates with piston and cylinder units operable to move the further casing and the rings relative to the frame of the cutter shield. To enable the interior of the cutter shield to be maintained at excess pressure, the rings engage with slidable seals on the rear shield and on the sheathing while a further slidable seal is provided between the further cowl and the casing of the cutter shield frame.

17 Claims, 2 Drawing Figures

TUNNEL DRIVING APPARATUS

BACKGROUND TO THE INVENTION

The present invention relates to apparatus for driving tunnels, galleries, roadways, adits and similar excavations referred to for convenience hereinafter simply as "tunnels".

It is known to produce a tunnel with the aid of apparatus in the form of a cutter shield with a plurality of elongate drive members or cutters supported on a frame. The drive members are advanced by means of rams and the frame is drawn up from time to time to progressively extend the tunnel. In order to support the tunnel wall behind the shield, various measures have been adopted in the past. For example, fluid concrete is introduced over sheathing behind the shield to create a permanent tunnel lining. It is known to provide the drive members with rear extensions or tails which form a rear shield within which the concrete can be introduced over the sheathing. German patent specification 2522029 describes apparatus with such prolonged drive members. The sheathing can be coupled to the frame of the cutter shield with the aid of hydraulic piston and cylinder units so that it can be drawn up and adjusted. An annular ring provides an end wall for the concrete reception space located between the rear shield and the sheathing. This ring can also be moved, for example, with hydraulic units and can thus compress the concrete introduced into the space. The driving and concreting operations can take place simultaneously and independently, thus saving considerable time. One drawback is, however, as the drive members are advanced, their rear tails leave a gap between the concrete lining and the tunnel wall and subsidence can occur. Other measures can be taken to overcome this problem. German patent specifications 2431652 and 2508407 describe tunnel driving apparatuses in which the drive members of the cutter shield have rear tails which are displaceably supported on an annular component forming a follow-up rear shield located at the rear of the cutter shield frame. The rear shield can be adjusted in relation to the frame. The rear tails of the drive members overlap the rear shield at all times and are thus firmly supported against the tunnel wall.

The frame of the cutter shield of known forms of tunnel driving apparatus usually consists of an open framework on which the drive members are supported and guided. When the tunnel is being driven in water-bearing strata, it is necessary to introduce compressed air into the interior of the cutter shield to maintain excess pressure therein. The compressed air tends to escape from the periphery of the shield, however, and needs to be constantly replaced. To overcome this problem, attempts have been made to provide seals between the drive members but this has not been particularly successful.

A general object of the present invention is to provide an improved tunnel driving apparatus.

SUMMARY OF THE INVENTION

Apparatus constructed in accordance with the invention comprises a shield with a plurality of elongate drive members, frame means supporting the drive members for individual longitudinal displacement and rams connected between the frame means and the drive members and operable to effect advancement of the shield in the tunnel driving direction. In accordance with the invention, the frame means includes a the drive members being disposed externally of the cowl. The cowl can be shaped to provide a recess open towards the drive members and the rams extend through sealed apertures in an end wall of the recess. The interior of the shield can be charged with compressed air to maintain excess pressure without significant loss of the compressed air. The frame means can be composed of an open framework with a sheet metal cover constituting the cowl surrounding the framework. Alternatively, a cylindrical cowl, preferably with reinforced walls, may itself form the frame means.

The apparatus is preferably adapted to permit fluid concrete to be introduced from the rear to form a permanent tunnel lining. The drive members can thus have rear portions or tails, preferably of reduced cross-section, forming a rear shield in known manner. It is desirable for the frame means to extend within the rear shield right up to the rear end zone of the rear portions of the drive members. A separate annular casing can be disposed within the rear shield. Preferably, this annular casing is positioned between the cowl of the frame means and the rear shield. Sealing means can then be provided between the separate annular cowl and the casing pertaining to the frame means. This sealing means, which may be an inflatable tube, allows sliding but prevents the escape of compressed air when the interior of the cutter shield is maintained under pressure. Means, such as piston and cylinder units, can permit the annular casing to be displaced relative to the frame means. A space for receiving fluid concrete used to create a tunnel lining can be defined at the rear of the apparatus. A ring or ring assembly can form an end wall of the reception space, while a single or multi-part shuttering or sheathing can form an inner periphery of the reception space. The sheathing can extend well within the rear shield. In contrast to known arrangements, no exterior sheathing is needed and the reception space can open directly to the tunnel wall. The ring or ring assembly can be combined with the annular casing as a structural unit. In a preferred embodiment of the invention, a pair of slidable rings is provided, one of which is fixed to the annular casing while the other forms the end wall of the reception space. The ring fixed to the annular casing preferably has a seal on its inner periphery which slidably engages on the sheathing. Similarly, the other ring has a seal on its outer periphery slidably engageable with the inside of the rear portions of the drive members. These additional seals also ensure that the interior of the cutter shield can be hermetically sealed.

The piston and cylinder units, or other means for displacing the annular casing, can engage directly on the first ring fixed to this casing. The units can thus exert thrust on the rings to compress the fluid concrete in the reception space. In this way, the pressure in the reception space can be controlled. The concrete lining can be built up in sections in known manner and separation strips can be inserted between these sections, if desired.

With apparatus constructed in accordance with the invention, the concreting operation can be performed at the same time as the tunnel driving without problems encountered hitherto and the critical zone between the rear of the apparatus and the tunnel lining is adequately supported. The apparatus is particularly adapted to perform with the interior of the cutter shield maintained under pressure.

The invention may be understood more readily, and various other features of the invention may become apparent, from consideration of the following description.

BRIEF DESCRIPTION OF DRAWINGS

An embodiment of the invention will now be described, by way of example, with reference to the accompanying drawing, wherein.

DESCRIPTION OF PREFERRED EMBODIMENT

Figure 1:
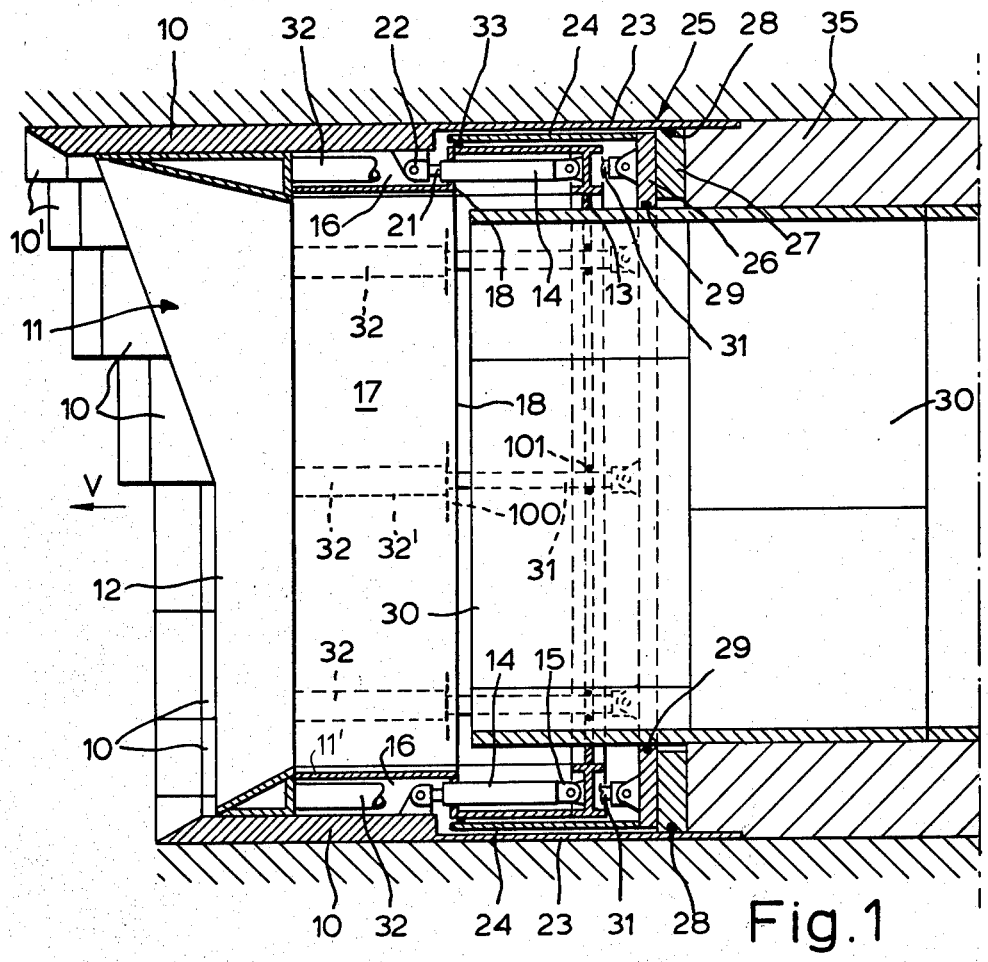
FIG. 1 is a schematic sectional side view of apparatus constructed in accordance with the invention.

As shown in the drawing, tunnelling apparatus employs a cutter shield composed of a plurality of elongate drive members or cutters 10 arranged side-by-side in a cylindrical array. The members 10 are supported for displacement on a common frame means 11 which, in this embodiment, has two annular end components 12,13 spaced-apart longitudinally of the apparatus and the tunnel being driven. The end components 12,13 are rigidly interconnected, e.g., by means of longitudinal and diagonal struts. The frame means 11 further comprises an external tubular cowl 11' which closes off the frame means 11 exteriorly over its entire length and periphery. The cowl can comprise a sheet metal cover stepped proximate its mid-point, as illustrated, mounted to the end components 12,13 and their connection struts. In an alternative construction, the frame means 11 is composed of an integral rigid tubular casing or cowl preferably with reinforced walls, e.g., boxlike, and the end components 12,13 as such can be dispensed with. Whichever construction is adopted, the drive members 10 are preferably guided for individual displacement on the exterior of the frame means 11, i.e., on the cowl or casing.

Double-acting hydraulic rams 14 are connected between the drive members 10 and the frame means 11. In the illustrated embodiment, the cylinders of the rams 14 lie predominantly inside of the larger diameter portion of the stepped cowl 11', and are connected with pivot joints 15 by to the rear end component 13. In known manner, the rams 14 advance the members 10 collectively in groups or individually and draw up the frame means 11 to effect advancement of the tunnel. The drive members 10 have cutting edges 10' at the forward ends, whereby they penetrate the working face as the rams 14 thrust the members 10 forwards in the advancing direction V. As the members 10 are urged forwards by the rams 14, either individually or in groups, the frame means 11 acts as an abutment for the reaction forces. When the rams 14 have all been extended by their full stroke, they are retracted in unison to draw up the frame means 11 and the frictional contact between the surrounding tunnel wall and the drive members 10 acts as an abutment for the reaction forces.

The frame means cowl 11' has a peripheral, smaller diameter recess 16 in its forward zone defined by the stepped shape of the external cowl. The recess 16 is, of course, closed-off from the interior 17 of the shield by the cowl, but the recess is open towards the drive members 10. As shown, particularly in FIG. 2, the rearmost wall 18 of the recess 16 is provided with apertures 19 through which the rams 14 extend to engage with the drive members 10. Seals 20 engage between the exteriors of the cylinders of the rams 14 and the surfaces of the apertures 19. As also shown in FIG. 2, the piston rods of the rams 14 are pivotably connected with joints 22 to brackets on the inside of the drive members 10.

Each drive member 10 has a rear portion 23 forming the so-called follow-up or rear tail. The portions 23 may be integral with the main drive members 10, as illustrated, or separately formed components connected to the main drive members 10. As shown in the drawing, the rear portions 23 are reduced in cross-section relative to the main drive members 10 and the rear portions 23 merge smoothly with the exteriors of the main drive members 10. The rear portions 23 thus combine to form a rear cylindrical shield which surrounds a separate annular casing 24. The casing 24 in turn supports a ring assembly 25. The assembly 25 is here composed of two rings 26,27. The ring 26 is affixed to the rear end of the casing 24 while the ring 27 is in face-to-face slidable engagement with the ring 26. The assembly 25 is thus able to adjust radially. The ring 27 forms an end wall of a reception space 35 for receiving fluid concrete and an inner sheathing 30 defines an inner periphery of this reception space 35. The ring 27 has a seal or packing 28 on its outer periphery which engages with the inside of the rear portions 23 of the drive members 10. The ring 26 has a similar seal or packing 29 on its inner periphery, which engages with the outside of the sheathing 30. The sheathing 30 may be a single component or, more preferably, made of a series of tube sections arranged end-to-end. The sheathing 30 can be connected to move with the frame means 11 or moved up independently.

Hydraulic piston and cylinder rams or units 32 are distributed around the outside of the cowl 11' with their cylinders 32' located predominantly in the recess 16 and supported on the forward end component 12. The cylinders 32' are fixed as at 100 in FIG. 1 to the rear wall 18 of the recess 16 and seat in bores therein. The cylinders 32' are mounted to the wall 18 in an air tight manner. The piston rods 31 of the rams 32 slidably extend through bores in the rear end component 13, and seals or packings 101 are provided between the piston rods 31 and the bores. The sealing arrangement depicted in FIG. 2 for the rams 14 is thus applied to the rams 32. The piston rods 31 of the units 32 are pivotably connected at their rear ends to brackets on the ring 26. The units 32 thus act to move the casing 24 and the ring assembly 25 relative to the frame means 11 in the direction of arrow V and reverse thereto.

Figure 2:
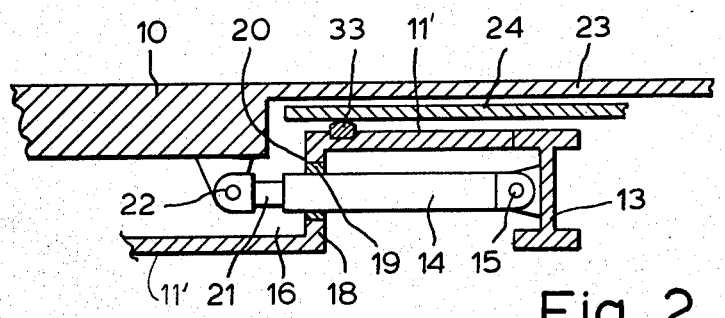
FIG. 2 is an enlarged sectional side view of part of the apparatus shown in FIG. 1.

As shown in FIG. 2, a seal or packing 33 is provided between the cowl 24 and the exterior casing of the frame means 11. As illustrated, the seal 33 locates in a groove in the cowl 11'. The seal 33 is flexible and may be in the form of an expandable tube which can be selectively expanded by the admission of pressure fluid, e.g., compressed air.

The driving operation is performed, as described hereinafter, by advancing the drive members 10 and drawing up the frame means 11 with the rams 14. There is considerable overlap between the rear shields composed of the portions 23 and the casing 24. As the drive members 10 move forwardly the rear tails or portions 23 slide over the seal 28 on the ring 27 and move past the casing 24. As the frame means 11 moves up, its cowl 11' slides with its seal 33 over the casing 24. During the advancement of the frame means 11 in the direction of arrow V, the the units 32 can be actuated to exert force on the rings 26, 27 to hold the ring assembly 25 and the casing 24 in position. This thrust force also maintains a certain back pressure in the space 35. However, the rings 26, 27 with the casing 24 can be advanced at the same time as the frame means 11 is being advanced. Preferably, the pressure of the concrete in the space 35 is monitored and the advancement of the ring assembly 25 and the casing 24 is controlled in accordance with the pressure. Concrete can be admitted to the space 35 to keep the latter filled and the fluid concrete can be maintained under a certain head of pressure. The fluid concrete can be supplied to the space 35 via one or more supply conduits as is known. The units 32 can also be actuated to slightly release the ring assembly 25 from the concrete mass to permit flexible membranes or strips to be introduced between successive sections of concrete in known manner.

The creation of a concrete lining for the tunnel can take place continuously as the driving progresses and there is no necessity for any outer sheathing for the concrete reception space 35. Where the tunnel is being driven in water-bearing strata the interior 17 of the apparatus can be maintained at excess pressure by exposure to compressed air. The front end zone of the interior 17 is closed off by the working face and the rear end zone of the interior 17 can be closed off by a bulkhead or the like. As the frame means 11 has an exterior cowl 11' and the seals 28, 29 and 33 are provided, the compressed air is unable to escape from the interior 17 to any significant extent.

We claim:

1. In apparatus for driving tunnels or the like; said apparatus comprising a shield with a plurality of elongate drive members (10), frame means (11) supporting the drive members for individual longitudinal displacement, and rams (14) connected between the frame means and the drive members and operable to effect advancement of the shield in a tunnel driving direction; the improvement comprising: the frame means including a cowl (11') defining a continuous, exterior, tubular, sealed enclosure with the drive members being disposed externally of the cowl, whereby compressed air may be admitted into and maintained within the shield.

2. Apparatus according to claim 1, wherein the cowl is shaped to provide a recess (16) open towards the drive members.

3. Apparatus according to claim 2, wherein the cowl is step-shaped in axial cross-section, and rams pass through sealed apertures (20) in a wall (18) of the cowl defining said step-shape.

4. Apparatus according to claim 1, wherein the drive members have reduced rear portions (23) which define a rear shield.

5. Apparatus according to claim 4, and further comprising a rigid movable annular casing (24) located within the rear shield.

6. Apparatus according to claim 4, and further comprising a rigid movable annular casing (24) located between the rear shield and the casing cowl of the frame means.

7. Apparatus according to claim 6, wherein additional sealing means (33) is provided between the annular casing and the casing cowl of the frame means.

8. Apparatus according to claim 5, wherein the annular casing supports a ring assembly (25) which provides an end wall for a concrete reception space (35).

9. Apparatus according to claim 8, wherein means (31, 32) is provided for displacing the ring assembly relative to the frame means.

10. Apparatus according to claim 8, wherein a sheathing (30) serves to provide a peripheral wall of the concrete reception space.

11. Apparatus according to claim 8, wherein the ring assembly is composed of first and second rings (26, 27), the first ring (26) being fixed to the annular casing.

12. Apparatus according to claim 11, wherein additional sealing means (28) is provided between the second ring and the rear shield.

13. Apparatus according to claim 10, wherein the ring (26) assembly is composed of first and second rings, the first ring being fixed to the annular casing and wherein sealing means (29) is provided between the first ring and the sheathing.

14. Apparatus according to claim 13, wherein additional sealing means (28) is provided between the second ring and the rear shield.

15. Apparatus according to claim 1, wherein said casing surrounds cowl extends between a pair of spaced-apart rigidly-interconnected annular frame components (12, 13).

16. Apparatus according to claim 5 and further comprising means (31, 32) for displacing the annular casing relative to the frame means.

17. Apparatus according to claim 8, and further comprising means for displacing the annular casing and the ring assembly collectively in relation to the frame means.

* * * * *